US008696828B2

(12) United States Patent
Classen et al.

(10) Patent No.: US 8,696,828 B2
(45) Date of Patent: Apr. 15, 2014

(54) WATER-CONDUCTING DOMESTIC APPLIANCE COMPRISING A DETERGENT DOSING SYSTEM AND CARTRIDGE THEREFOR

(75) Inventors: Egbert Classen, Wertingen (DE); Helmut Jerg, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 960 days.

(21) Appl. No.: 12/311,098

(22) PCT Filed: Aug. 29, 2007

(86) PCT No.: PCT/EP2007/058970

§ 371 (c)(1),
(2), (4) Date: Mar. 18, 2009

(87) PCT Pub. No.: WO2008/034692

PCT Pub. Date: Mar. 27, 2008

(65) Prior Publication Data

US 2010/0000580 A1 Jan. 7, 2010

(30) Foreign Application Priority Data

Sep. 19, 2006 (DE) ..... 10 2006 043 915

(51) Int. Cl.

| | |
|---|---|
| ***B08B 7/00*** | (2006.01) |
| ***B08B 7/04*** | (2006.01) |
| ***B08B 3/00*** | (2006.01) |

(52) U.S. Cl.

USPC .... 134/57 D; 134/56 R; 134/56 D; 134/58 D; 134/18; 134/25.2

(58) Field of Classification Search

USPC ..... 134/56 R, 57 D, 56 D, 58 D, 25.2, 18

See application file for complete search history.

(56) References Cited

U.S. PATENT DOCUMENTS

| | | | |
|---|---|---|---|
| 2002/0088502 | A1 | 7/2002 | Van Rompuy et al. |
| 2004/0122555 | A1 | 6/2004 | Howes, Jr. et al. |
| 2005/0126608 | A1 | 6/2005 | DeWeerd et al. |
| 2006/0059958 | A1 | 3/2006 | Byrne et al. |
| 2007/0144558 | A1 | 6/2007 | Classen et al. |
| 2007/0210118 | A1 | 9/2007 | Gadini |

FOREIGN PATENT DOCUMENTS

WO WO 2005058126 A1 * 6/2005

* cited by examiner

*Primary Examiner* — Alexander Markoff

(74) *Attorney, Agent, or Firm* — James E. Howard; Andre Pallapies

(57) ABSTRACT

A water-conducting domestic appliance, in particular a domestic dishwasher, the water-conducting domestic appliance including a washing compartment for receiving items therein that are to be subjected to a washing cycle by the water-conducting domestic appliance; a detergent dosing system, the detergent dosing system having a detergent dispenser with a receiving compartment, the receiving area for receiving at least one cartridge that is configured to hold at least one detergent; and a cartridge having separate chambers for storing at least two detergents, each chamber having a storage capacity for storing detergent that is greater than a quantity of detergent required for one washing cycle.

34 Claims, 3 Drawing Sheets

WATER-CONDUCTING DOMESTIC APPLIANCE COMPRISING A DETERGENT DOSING SYSTEM AND CARTRIDGE THEREFOR

BACKGROUND OF THE INVENTION

The invention relates to a water-conducting domestic appliance in accordance with the preamble of claim 1.

The majority of domestic dishwashers currently in use, for example, have an adding device for receiving one or more detergent(s) which are added to the washing water during the course of a washing cycle in order to clean the items for washing that are shelved in the dishwasher. All of the detergent held in the adding device is conventionally dispensed into the washing compartment during the washing cycle and mixed into the washing water circulated therein. In terms of its size, the adding device is dimensioned such that the precise quantity of detergents required for a washing cycle can be poured in. At the start of each washing cycle the user of the dishwasher is therefore required to pour into the adding device the quantity of detergent needed for the washing cycle. This operation is not convenient for the user of the dishwasher. Furthermore, with dishwashers of this kind there is the problem of the quantity of detergents poured into the adding device potentially varying from user to user and also from washing cycle to washing cycle. An incorrectly dosed quantity of detergent can lead to unsatisfactory wash results on the one hand—if an inadequate dose of detergents has been added, and lead to wasting of detergents, and environmental pollution therefore, on the other hand—if an excessive quantity of detergents has been added.

Moreover, adding devices, which add the quantity of detergents stored therein to the washing water in one go, do not allow more complex washing programs to be carried out. Thus for example in certain situations it may be expedient to add the detergent to the washing water at different times. Adding devices, which are designed to receive a single detergent dose, cannot support such complex washing cycles.

BRIEF SUMMARY OF THE INVENTION

The object of the invention is to provide a water-conducting domestic appliance which can also perform complex washing cycles. The object of the invention is also to provide auxiliary means for this purpose.

This object is achieved according to the invention by a water-conducting domestic appliance having the features described in claim 1. Advantageous embodiments are set down in the dependent claims.

A water-conducting domestic appliance, in particular a domestic dishwasher, has a detergent dosing system which has at least one detergent dispenser for receiving at least one cartridge, the cartridge having separate chambers for storing at least two detergents. The invention is characterized in that the quantity of detergent stored in each chamber is greater than the quantity required for one washing cycle. During a washing cycle, the detergent dosing system for receiving the cartridge essentially provides precisely the quantity of detergent which is required for one washing cycle. Detergents can be combinations of cleaning agent components or individual cleaning agent substances, such as an enzyme for example. The detergents can be in a liquid form or also a gel form. A plurality of detergents can be arranged in chambers of the cartridge. Provision can however also be made such that the detergent dosing system is designed for receiving an appropriate number of cartridges having only one chamber. The storage of different detergents in different chambers has the advantage that in a particular step of a washing cycle only the detergent which is actually required for this washing step needs to be added. It is naturally possible that during a particular step of a washing cycle a plurality of the detergents can also be added simultaneously. Inasmuch as two detergents different from one another are basically added simultaneously to the washing water during a washing cycle, it is also possible to arrange these detergents in a common chamber of the cartridge.

In this situation, provision is preferably made for the detergent dispenser to be arranged in an internal space in the water-conducting domestic appliance.

According to one embodiment, the storage capacities of the chambers for receiving at least two detergents are dimensioned such that between 20 and 40, preferably 30, washing cycles can be performed.

By preference, provision is made for the cartridge to have chambers separated from one another for storing more than 2 and less than 10, preferably 7, detergents. This makes it possible to forego storing combinations of cleaning agent components and instead to store individual cleaning substances, such as alkaline solutions, bleaching agents, complexing agents and also enzymes and to add these as required. In this situation, the selective addition of complexing agents for example makes it possible to regulate the water hardness such that a dishwasher according to the invention can be designed without a water softening facility. The regulation of the water hardness can take place under sensor control or manually through an operator. In addition, an adjustment of the added substances to suit the length of a selected cleaning program can take place thus.

According to a further embodiment, the respective chambers are arranged in a common housing of the cartridge, a cartridge housing in other words, from which results a particularly simple handling operation for the user.

According to a further embodiment, a ventilation chamber is provided in the cartridge, which is operatively connected with the chambers containing the detergents. In this situation, the ventilation chamber is connected with the chambers containing the detergents by way of ventilation channels in a common cover covering the individual chambers. This serves to ensure that no vacuum can become established in the chambers as the latter become increasingly empty, as a result of which the addition of detergents to the washing water would become more difficult or may not occur in the correct quantity. In this case the ventilation chamber is preferably part of the cartridge.

A further embodiment provides for the fact that the cartridge is provided with at least one openable closure which can be opened, in particular automatically, on insertion into the detergent dosing system and can be closed, in particular automatically, on removal of the cartridge from the detergent dosing system. The openable closure can be formed for example by a membrane. During storage and transportation the closure serves to prevent the detergent stored in the cartridge from accidentally spilling out. Opening of the closure takes place at that moment at which the cartridge is inserted into the detergent dispenser of the detergent dosing system such that an addition of detergent to the washing water is possible during further operation of the dishwasher. The number of closures can vary, depending on the construction of the cartridge. Advantageously, a number of closures corresponding to the number of chambers in the cartridge is provided. The number of closures can also correspond to the number of detergents in the cartridge. The openable closure can be arranged for example below in the direction of gravity, in other words at the base of the cartridge, when the cartridge is situated in the installation position in the detergent dosing system. The complete emptying of the cartridge through the delivery device is facilitated by this means, as a result of which no detergent remains unused in the cartridge.

A further embodiment makes provision for the cartridge to have at least one delivery device, by means of which the at least two detergents can be delivered into the washing compartment of the dishwasher. This procedural method has the advantage that the detergent dispenser of the detergent dosing system according to the invention can be configured particularly simply in its construction. According to this embodiment, the devices necessary for dosing the detergents contained in the cartridge into the washing compartment are contained exclusively in the cartridge. In this situation, provision can be made such that a number of delivery devices corresponding to the number of detergents or chambers are provided.

In one variant, the delivery of the at least two detergents takes place by way of the force of gravity and in a further variant by means of defining an outflow time during which the at least two detergents can be delivered from the cartridge by way of the openable closure for further processing. In this variant, the openable closure of the cartridge is necessarily arranged below in the direction of gravity when the cartridge is situated in its installation position in the detergent dosing system.

The dishwasher has a control unit which is operatively connected to at least one openable closure and which is designed in accordance with the following formula in order to determine the outflow time of the at least two detergents:

$$t_n = x + (n-1) \cdot y$$

where t is the outflow time of the detergent, n is the number of the washing operation, x is the outflow time of the detergent of the first washing operation, and y is a constant.

The control unit of the dishwasher thus controls the dosing of the detergent or of the detergents.

In accordance with this variant, the outflow time is adapted after each dosing or after each washing cycle. This procedural method serves to ensure that with regard to a particular washing program it is always the same volume that is added to washing water regardless of the quantity of detergent contained in the cartridge. With the above formula, the effect of gravity and the volume of detergent contained in the cartridge and thus the speed of outflow when the closure is opened are taken into consideration.

In a different variant, the dosing of the at least two detergents can be performed by means of a pump or some other actuator.

In order to prevent incorrect insertion of the cartridge into a detergent dispenser of the detergent dosing system, the housing of the cartridge has a mechanical coding, a lug for example, which corresponds with a matching depression in the detergent dosing system. The coding is configured in such a manner that the cartridge can only be inserted in a single way—the predetermined manner—into the detergent dispenser.

The cartridge can have any suitable form. By preference however, provision is made such that the housing of the cartridge has a longitudinal extension along a main axis. In this situation, the base body in question can for example have a rectangular shape with a longitudinal axis, along the width for example, which is considerably longer than all the other axes (along the depth and the height). The base body in question can however also have a conical, truncated conical, cylindrical, pyramidal or truncated pyramidal shape with a main axis.

In this situation it is preferable for the main axis to be longer than secondary axes of the housing with one of the aforementioned basic shapes of the cartridge, by a factor of at least 1.5 for example. Furthermore, the base body can preferably have one extension along a first secondary axis, along the height for example, and one extension along a second secondary axis, along the depth for example, the extension along the first secondary axis being considerably longer than the extension along the second secondary axis, by a factor of 3 to 10 for example, preferably 5. Especially good handling of the cartridge and an advantageous volume for the respective detergents result when the housing of the cartridge has a rectangular basic shape having a depth of about 25 mm, a width of about 200 mm and a height of about 125 mm. In particular, the preferred total number z of washing cycles between 20 and 40, preferably 30, can be implemented with such dimensions.

In one preferred development, provision is made for the chambers of the cartridge to be arranged beside one another along the main axis. In other words, in the case of a cartridge having a rectangular basic shape and a main axis extending in the direction of the width, the division into chambers results in chamber dimensions whereby the dimension of one chamber is a proportion of the width corresponding to the number of chambers, while an equal depth and height is given for all chambers.

According to a further embodiment, at least one section of the cartridge facing the washing compartment of the water-conducting domestic appliance when the cartridge is located in the detergent dosing system has thermal insulation which limits a heat flow from the washing compartment in the direction of the detergent dosing system. The long-term stability of the detergents stored in the cartridge is advantageously ensured as a result of this course of action. This allows the use of detergents such as contain temperature-sensitive substances. The thermal insulation prevents or limits excessively strong temperature variations in the detergent stored in the cartridge. This procedural method is advantageous in particular in the situation when the quantity of detergent stored is designed for a very large total number of washing cycles.

The thermal insulation in the section of the cartridge facing the washing compartment of the dishwasher can be formed by a gas volume arranged in the section. It is possible to manufacture the housing body from a plastic by using the gas injection molding process (GID) known from the prior art, in which a gas-filled cavity is embedded into the section manufactured from an injectable material, such as plastic. The insulation can also be formed by means of a solid or liquid insulating material arranged in the section. This insulating material can be present in addition to the material comprising the housing section of the cartridge. The housing section can also be formed by the insulating material. Combinations of the aforementioned materials are also conceivable.

The cartridge can furthermore have a means for measuring the level of the detergent volume contained in the cartridge. In one variant, the means for level measurement can be designed to emit a signal when the detergent contained in the cartridge has been completely used up. This serves as a signal to the user of the dishwasher that it is necessary to replace the cartridge for correct operation of the dishwasher in preparation for the next washing cycle. In a different variant, the means for level measurement is designed to emit a signal when the detergent contained in the cartridge is sufficient for performing a predefined number m of washing cycles. In this situation the number m of washing cycles can in principle be chosen at will, whereby m is preferably chosen between 2 and 5. By this means, a future need to replace the cartridge is indicated to the user of the dishwasher. The user is however still in a position to use the dishwasher for a certain number of washing cycles, with the result that time still remains in order to procure a new cartridge.

In one embodiment, provision is made for the means for level measurement to be arranged in only one of the chambers of the cartridge for determining the fill level of the detergent in this chamber. The information about the fill level of a single one of the chambers is sufficient in order to deduce the fill level of the entire cartridge because the volume of the detergents in the respective chambers is dimensioned such that each of the detergents in the chambers is used up by the z-th washing cycle and in each washing operation an equal percentage proportion of the at least two detergents is dosed by the dosing system. With a low requirement in terms of monitoring facilities, this procedural method permits a precise prediction of the fill level of respective detergents in the cartridge.

The means for level measurement can be based on an optical, acoustic or capacitive principle of measurement.

A detergent dosing system also belongs to the invention.

BRIEF DESCRIPTION OF THE DRAWINGS

The invention will be described in detail in the following with reference to the figures. In the drawings.

DETAILED DESCRIPTION OF THE PRESENT INVENTION

Figure 1:
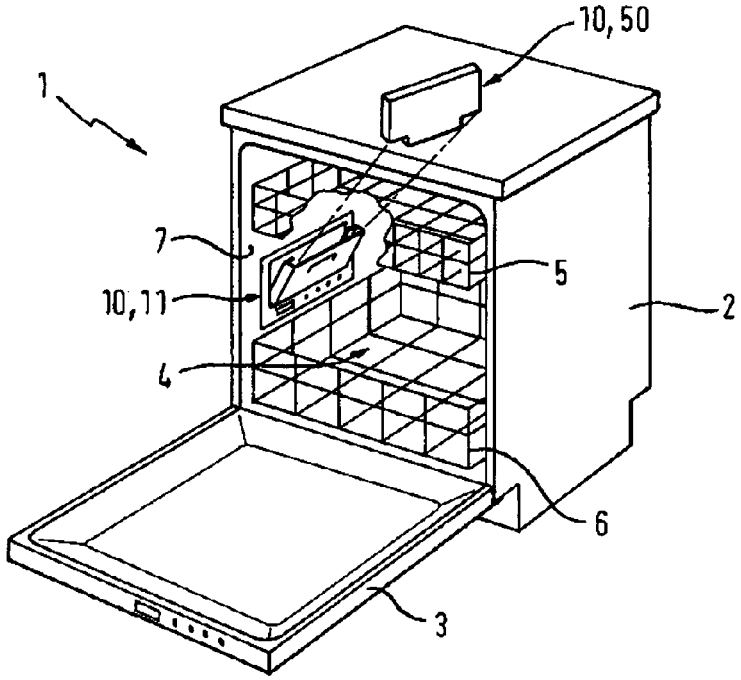
FIG. 1 shows a dishwasher with a detergent dosing system for receiving a cartridge according to the invention, which is arranged in a container wall.

FIG. 1 shows a dishwasher 1 according to the invention comprising a door 3 pivotably mounted on a housing 2. The figure shows the door 3 in its open position. Crockery racks 5, 6 are arranged in a known manner in a washing compartment 4 that can be closed by the door 3. A detergent dosing system 10, comprising a detergent dispenser 11 and a cartridge 50, which contains at least two detergents that are held separately from each other, is arranged in a container wall 7 of the housing 2. FIG. 1 shows the preferred arrangement of the detergent dosing system 10 between the top rack 5 and the bottom rack 6. The detergent dispenser 11 that receives the cartridge 50 is arranged in a section of the container wall 7 that is located close to the door opening in order to facilitate introduction and removal of the cartridge 50 into or from the detergent dispenser 11 for the user.

The detergent dispenser 11 comprises a housing 12 and a cover which is pivotably mounted with respect to the housing 12. When the cover is in its open position (cf. illustration in FIG. 1), then the cartridge 50 can be inserted into the cover from the washing compartment 4. The cover has, for example, two symmetrically arranged retaining plates for retention and fixing purposes which have an L-shaped design and are matched to the size of the cartridge 50 such that the retaining plates encompass and retain the cartridge 50 after it has been inserted. In addition, a supporting surface is formed on the cover such that the cartridge 50 comes to rest in a defined position (not shown). When the cover is closed, the cartridge is brought into a receiving space in the detergent dispenser 11 and pushed into its final position by means of projections and/or lugs which may be present on the housing of the detergent dispenser.

Figure 3:
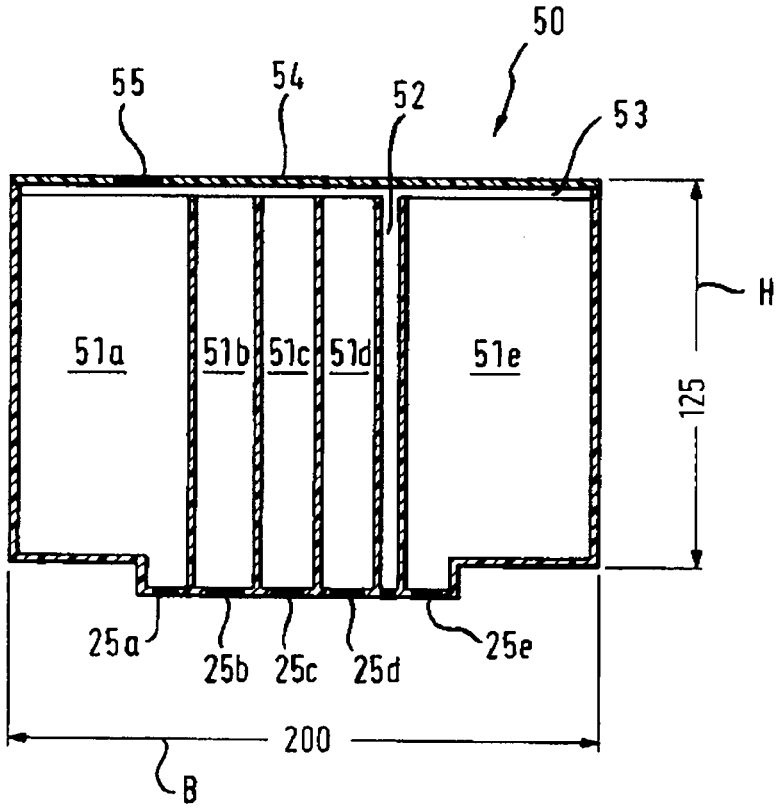
FIG. 3 shows an exemplary embodiment of a cartridge for use in the detergent dosing system.

An exemplary embodiment of the cartridge 50 according to the invention is illustrated in FIG. 3. The cartridge 50 simply has five chambers 51*a*, 51*b*, 51*c*, 51*d* and 51*e*, by way of example, for receiving a detergent or a detergent mixture in each case. In this situation, the size of the individual chambers 51*a* to 51*e* is dimensioned according to the volume required during a predefined number of washing cycles. The volume of the different detergents in the chambers 51*a* to 51*e* is dimensioned in such a manner that after a particular number of washing cycles, preferably between 20 and 40, by further preference approx. 30, all of the chambers 51*a* to 51*e* are completely emptied.

The total number of washing cycles involved in exhausting the cartridge depends on the type of the washing cycles performed in each case. In order to satisfy the different requirements, for each program which can be selected in the dishwasher a particular dosage quantity is predefined, or determined by means a sensing system. In the case of a lightly soiled washing load a smaller dosage quantity is chosen, whereas a higher dosage quantity of detergents is provided for a heavily soiled washing load. In order to ensure that each of the detergents is used up by the same washing cycle, the percentage proportion of each detergent component which is added to the washing water during a washing cycle is equal. This enables economical usage of the available resources since the cartridge is only replaced when it has been completely emptied. Furthermore, this procedural method also makes sensing of the fill level simpler because it is sufficient to sense the fill level in only one of the chambers of the cartridge in order to obtain information about the fill status of the entire cartridge.

Each of the chambers 51*a* to 51*e* is provided with an openable closure 25*a* to 25*e*, taking the form of a membrane for example. The membranes, consisting of rubber for example, give a sealed closure for the individual chambers 51*a* to 51*e* such that no detergent can escape from the cartridge 50 during storage and transportation thereof. When the cartridge 50 is inserted into the detergent dispenser 11, the membranes are punctured by cannulas 21 arranged correspondingly in the detergent dispenser 11 (cf. FIG. 4), such that detergent can be added to the washing compartment in accordance with an appropriate dosing device.

The cartridge is preferably manufactured from a plastic and has a width B of approx. 200 mm, a height H of approx. 125 mm and a depth of approx. 25 mm. With these dimensions, the volume of the different chambers can be dimensioned such that the desired 20 to 40 washing cycles can be performed by means of one cartridge.

In addition to the chambers 51*a* to 51*e*, the cartridge 50 has a further chamber 52 which is connected with one or more ventilation channels 53. The ventilation channel or channels 53 for their part have a connection with the different chambers 51*a* to 51*e*. This serves to ensure that as the chambers 51*a* to 51*e* become increasingly emptied no vacuum can build up therein, on account of which the addition of detergents would be rendered more difficult or falsified. The ventilation channels 53 are preferably situated in a cover 54 which is fitted on the housing of the cartridge after the individual chambers 51*a* to 51*e* have been filled with the respective detergents. The cover 54 can have an overpressure valve 55 which may be necessary in the case of certain detergent components.

Since the detergents contained in the cartridge 50 are only added to the washing compartment, or more precisely to the washing water agitated in the washing compartment, little by little in the course of a plurality of washing cycles, said detergents are subjected to considerable absolute temperatures and temperature variations with each washing cycle. In order to prevent the properties of the detergents from changing with time as a result thereof, at least one housing wall of the cartridge 50 facing the washing compartment and/or the cover of the detergent dosing system 10 facing the washing compartment is/are manufactured from an insulating material or surrounded by insulation. This serves to limit a heat flow from the washing compartment in the direction of the detergent dosing system or the detergents stored in the cartridge, with the result that the long-term stability of the detergents used is ensured. The insulation can be formed by a gas volume arranged in the cover or the relevant housing section of the cartridge. This gas volume constituting the insulation can be incorporated during the course of manufacture of the cover or of the cartridge. The method used here is known as the gas injection molding process (GID).

In addition to the receiving area for the cartridge, the detergent dispenser 11 can have a further chamber for receiving a solid detergent. With regard to the solid detergent, this can for example be a 3-in-1 tablet which is inserted into the further chamber when the receiving space contains no, or an empty, cartridge 50. The provision of the further chamber for receiving a solid detergent makes it possible to use the dishwasher even when the cartridge 50 is empty and no filled cartridge is available.

The further chamber can have an opening which is connected to the ambient environment of the dishwasher. For this purpose, the opening can be connected with the ambient environment by way of channels running on the back of the container wall. The detergent dosing system thus integrates the functionality of a so-called "expansion opening" which serves to dissipate the overpressure occurring in the washing compartment if the dishwasher is, for example, opened and closed again by the user during a washing cycle with already heated washing water. The overpressure occurring at this moment can then be dissipated by way of the further chamber and the opening to the ambient environment.

The detergent dosing system can have means for interrogating the fill level of the detergents in the cartridge in order to detect an empty or almost empty cartridge. When the detergent in one or more of the chambers of the cartridge reaches a predefined fill level, for example when a predefined number of washing cycles is still possible, then this can be indicated to the user by way of an optical signal. The display device can be situated in a known manner, for example on the outside of the door, on the faceplate for example.

The interrogation of the fill level can be performed in an optical, capacitive or acoustic manner.

With regard to an optical interrogation, a light guide can be incorporated in the cartridge, into which light guide is incoupled light by way of a light source present in the detergent dispenser, for example. A light receiver, which is coupled with the light guide and which for example is likewise arranged in the detergent dispenser, receives the light outcoupled from the light guide. An evaluation system coupled with the light source and the light receiver can ascertain the fill level or when a predefined fill level is reached in the cartridge on the basis of the incoupled and outcoupled light quantity.

With regard to a capacitive interrogation, the detergent present in the cartridge can be used as an electrode. A further electrode, manufactured from an electrically conducting material, can be arranged on the detergent dispenser or on the outside wall of the cartridge. The housing material of the cartridge and, where applicable, further housing material of the detergent dispenser and/or an air gap formed between them form a dielectric between the two electrodes. By evaluating the voltage present between these two electrodes, it is possible to deduce the fill level of the detergents in the cartridge.

It is likewise possible to determine the fill level by using an acoustic principle. In this case, a generator provided on the detergent dispenser for example causes the detergent in the cartridge to oscillate. The noises arising during this process can be captured, by means of a microphone for example, and evaluated. The fill level of the detergents in the cartridge can be deduced on the basis of the noise spectrum.

Alternatively, a counter can be used for counting the washing cycles already performed with a full cartridge. In order to enable recognition of a new cartridge, this can be provided with a transponder which can be read out by the dishwasher or the detergent dispenser. Alternatively, a different code, a bar code for example, can be affixed to the cartridge. Reading of the code can take place, for example, on inserting the cartridge into the detergent dispenser.

It is sufficient if the means for level measurement is provided in only one of the chambers of the cartridge. Regardless of this possibility, any of the chambers can naturally be equipped with a separate means for level measurement.

Figure 4:
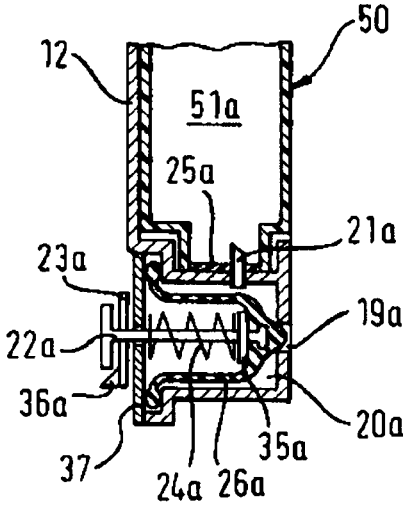
FIG. 4 shows a section through a detergent dosing system, whereby a delivery device arranged in a dosing chamber is illustrated, with which detergent can be delivered from the cartridge according to the invention to the washing compartment of the dishwasher.

Outlets 19*a* to 19*e* are provided in the housing 12 of the detergent dispenser 11 (cf. FIG. 4). The outlets 19*a* to 19*e* open in each case into a dosing chamber 20*a* to 20*e*, whereby only the dosing chamber 20*a* can be seen in the sectional drawing shown in FIG. 4. The dosing chamber 20*a* is connected with the chamber 51*a* of the cartridge by way of the channels 21*a*.

In each of the dosing chambers 20*a* to 20*e* is arranged a delivery device which in the present exemplary embodiment consists of a seal 26*a* mounted so it can move in the dosing chamber 20*a* and a drive mechanism for the seal 26*a*. The seal 26*a* is formed in such a manner that it can move between a position closing the associated outlet (19*a* in the figure) and a position unblocking the outlet. To this end, the seal 26*a* is connected to a valve lifter 22*a*. A movement of the valve lifter 22*a* is effected by a valve actuating lever 23*a*, on which is formed a tapered lug 36*a*. By means of a rotary motion of the valve actuating lever 23*a* the lug strikes the plate of the valve lifter 22*a* and causes a lift. When the valve actuating lever 23*a* is actuated, the seal 26*a* is withdrawn away from the outlet 19*a*. When the valve actuating lever 23*a* is returned to its initial position (by means of a rotary motion in the opposite direction), a restoring force is built up by a spring 24*a*, tensioned between a housing cover 37 and a support 35*a* provided on the valve lifter 22*a*, which positions the seal 26*a* intimately on the outlet 19*a*.

When the seal 26*a* is in its open position, then the detergent contained in the chamber 51*a* can enter the washing compartment through the cannula 21*a* into the dosing chamber 20 and by way of the outlet 19*a* as a result of gravity or an active delivery device, such as a pump for example.

In order to ensure that the same volume is added to the washing water regardless of the fill level of the respective detergents in the cartridge, the outflow time during which the detergents can be delivered from the cartridge for further processing by opening the openable closure is varied depending on the number of the washing cycle just performed since the insertion of a new, full cartridge. The outflow time of the detergents is determined according to the formula $$t_n = x + (n-1) \cdot y$$

where t is the outflow time of the detergent or detergents, n is the number of the washing cycle, x is the outflow time of the detergent or detergents for the first washing operation, and y is a constant.

As the number of the washing operation increases, the outflow time of the detergent or detergents is thus extended so that allowance is made for the reduction in pressure as the volume of detergent in the cartridge decreases.

In this situation, the delivery of the detergent can take place exclusively by utilizing gravity. The delivery device, in particular the design of the seal, can however also be constructed on the principle of a pump, such that detergents are delivered from the cleaning chamber 21*a* into the dosing chamber 20*a* and from the dosing chamber 20*a* into the washing compartment.

Figure 2:
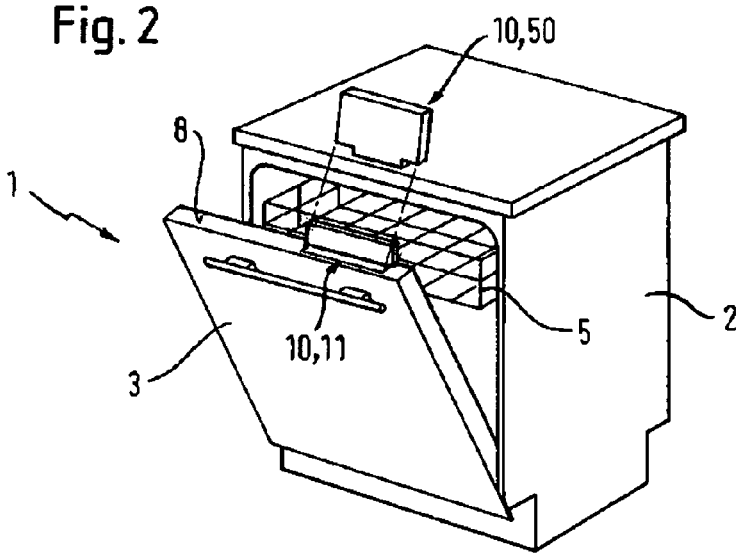
FIG. 2 shows a further dishwasher with a detergent dosing system for receiving a cartridge, which is arranged in the door of the dishwasher.

FIG. 2 shows a further dishwasher 1 with a detergent dosing system 10. In contrast to the exemplary embodiment described previously, the detergent dosing system 10, more precisely the detergent dispenser 11, is arranged in the door 3 of the dishwasher. The process of equipping the detergent dispenser 11 with the cartridge 50, which for the rest can be designed in identical manner as described in conjunction with FIG. 3, takes place from the front side 8 of the door. In this situation, the opening for equipping the detergent dispenser 11 can be arranged in the area of a faceplate on the dishwasher or of the inner door of the door. The advantage of the arrangement according to FIG. 2 consists in greater convenience for the user when inserting and removing the cartridge.

LIST OF REFERENCE CHARACTERS

1 Dishwasher
2 Housing
3 Door
4 Washing compartment
5 Crockery rack
6 Crockery rack
7 Container wall
8 Front side of door
10 Detergent dosing system
11 Detergent dispenser
12 Housing
13 Housing wall (=cover)
16 Holding clip
18 Pivoting mechanism
19*a*-19*e* Outlet
20*a*-20*e* Dosing chamber
21*a*-21*e* Cannula
22*a*-22*e* Valve lifter
23*a*-23*e* Valve actuating lever (disk)
24*a*-24*e* Spring
25*a*-25*e* Membrane
26*a*-26*e* Seal
34 Faceplate
35*a*-35*e* Support
36*a*-36*e* Lug
37 Housing cover
50 Cartridge
51*a*-51*e* Chamber for detergent
52 Chamber for ventilation
53 Ventilation channel
54 Cover
55 Overpressure valve
H Height
B Width

The invention claimed is:

1. A domestic dishwasher, comprising:

a washing compartment for receiving items therein that are to be subjected to a washing cycle by the domestic dishwasher;

a detergent dosing system, the detergent dosing system having a detergent dispenser with a receiving compartment, the receiving compartment for receiving at least one cartridge that is configured to hold at least one detergent;

a cartridge having separate detergent chambers for storing at least two detergents, each detergent chamber having a storage capacity for storing detergent that is greater than a quantity of detergent required for one washing cycle;

a first openable closure on the cartridge, the first openable closure being for detergent delivery and is opened automatically on insertion of the cartridge into the detergent dosing system and is closed automatically on removal of the cartridge from the detergent dosing system;

a first delivery device for controlling detergent delivery from the first openable closure to the washing compartment, the first delivery device being fluidly connected to the first openable closure and the washing compartment, and being located fluidly between the first openable closure and the washing compartment; and a control unit operatively connected to the first delivery device and configured to deliver control signals to the first delivery device to control an outflow time of a first detergent of the at least two detergents in a washing operation, the outflow time being dependant on a number of washing operations performed with the cartridge.

2. The domestic dishwasher according to claim 1 wherein the detergent dispenser is disposed in an internal space in the domestic dishwasher.

3. The domestic dishwasher according to claim 1 wherein the storage capacities of the detergent chambers are dimensioned such that between about 20 and about 40, preferably about 30, washing cycles can be performed.

4. The domestic dishwasher according to claim 1 wherein the detergent chambers are separated from one another for storing more than about 2 and less than about 10, preferably about 7, detergents.

5. The domestic dishwasher according to claim 1 wherein the detergent chambers are arranged in a common cartridge housing.

6. The domestic dishwasher according to claim 1 and further comprising a ventilation chamber in communication with the detergent chambers.

7. The domestic dishwasher according to claim 6 wherein the ventilation chamber is part of the cartridge.

8. The domestic dishwasher according to claim 6 wherein the ventilation chamber is communicated with the detergent chambers by ventilation channels formed in a cover member covering the detergent chambers.

9. The domestic dishwasher according to claim 1 wherein the cartridge has one openable closure for each of the detergent chambers.

10. The domestic dishwasher according to claim 1 wherein the first openable closure of the cartridge in an installed position in the detergent dosing system is disposed below in the direction of gravity.

11. The domestic dishwasher according claim 1 wherein the first openable closure is formed by a membrane.

12. The domestic dishwasher according to claim 1 wherein one of the at least two detergents is delivered into the washing compartment through the first delivery device by the force of gravity.

13. The domestic dishwasher according to claim 1 wherein the first detergent is delivered into the washing compartment through the first delivery device and the first delivery device is controlled by the control unit so that the delivery of the first detergent takes place within a predetermined outflow time period.

14. The domestic dishwasher according to claim 1, wherein the control unit is configured to determine the outflow time in accordance with the following formula:

$$t_n = x + (n-1) \cdot y$$

where t is the outflow time of the detergent, n is the number of the washing operation, x is the outflow time of the detergent in a first washing operation, and y is a constant;

and the control unit is configured to deliver the control signals corresponding to the determined outflow time.

15. The domestic dishwasher according to claim 1 wherein at least one pump is provided for dosing at least one detergent.

16. The domestic dishwasher according to claim 1 wherein the cartridge has a cartridge housing, the cartridge housing has a mechanical coding which can interact with a matching coding on the receiving compartment in order to define an installation position of the cartridge in the dishwasher.

17. The domestic dishwasher according to claim 1 wherein the cartridge has a cartridge housing and the cartridge housing has a longitudinal extension along a main axis.

18. The domestic dishwasher according to claim 17 wherein the main axis is longer than secondary axes of the cartridge housing.

19. The domestic dishwasher according to claim 17 wherein the detergent chambers of the cartridge are arranged beside one another along the main axis.

20. The domestic dishwasher according to 17 wherein the cartridge housing extends along the main axis a distance that is at least 1.5 times as long as a distance the cartridge housing extends along a secondary axis.

21. The domestic dishwasher according to claim 20 wherein a distance the cartridge extends along a first secondary axis is greater by a factor of at least 3 than a distance the cartridge extends along a second secondary axis.

22. The domestic dishwasher according to claim 1 wherein the cartridge has a cartridge housing and at least one section of the cartridge housing facing the washing compartment of the dishwasher, when the cartridge is arranged in the detergent dosing system, includes thermal insulation which at least limits a heat flow from the washing compartment in a direction toward the detergent chambers.

23. The domestic dishwasher according to claim 22 wherein the thermal insulation is formed by a gas volume arranged in the at least one section of the cartridge housing.

24. The domestic dishwasher according to claim 22 wherein the thermal insulation is formed by an insulating material including at least one of a solid insulating material and a liquid insulating material.

25. The domestic dishwasher according to claim 23 wherein the thermal insulation includes a combination of different materials which are disposed behind one another in a direction of heat propagation.

26. The domestic dishwasher according to claim 1 wherein at least one arrangement is provided for fill level measurement of at least one detergent volume contained in one of the detergent chambers.

27. The domestic dishwasher according to claim 26 wherein the arrangement for fill level measurement is configured to emit a signal when the detergent contained in the cartridge is measured to be less than a predefined quantity.

28. The domestic dishwasher according to claim 27 wherein the arrangement for fill level measurement is configured to emit a signal when the detergent contained in the cartridge is sufficient for performing a predefined number of washing cycles.

29. The domestic dishwasher according to claim 28 wherein the number of washing cycles is between about 2 and about 5.

30. The domestic dishwasher according to claim 26 wherein the arrangement for fill level measurement includes at least one of an optical measuring device, an acoustic measuring device and a capacitive measuring device.

31. A detergent dosing system for domestic dishwashers having a washing compartment, the detergent dosing system comprising:

a detergent dispenser with a receiving compartment, the receiving compartment for receiving at least one cartridge that is configured to hold at least one detergent;

a cartridge having separate detergent chambers for storing at least two detergents, each detergent chamber having a storage capacity for storing detergent that is greater than a quantity of detergent required for one washing cycle; and a first openable closure on the cartridge, the first openable closure being for detergent delivery and is opened automatically on insertion of the cartridge into the receiving compartment and is closed automatically on removal of the cartridge from the receiving compartment;

a first delivery device for controlling detergent delivery from the first openable closure to the washing compartment, the first delivery device being fluidly connected to the first openable closure and the washing compartment, and being located fluidly between the first openable closure and the washing compartment; and a control unit operatively connected to the first delivery device and configured to deliver control signals to the first delivery device to control an outflow time of a first detergent of the at least two detergents in a washing operation, the outflow time being dependant on a number of washing operations performed with the cartridge.

32. The detergent dosing system according to claim 31, wherein the control unit is configured to determine the outflow time in accordance with the following formula:

$$t_n = x + (n-1) \cdot y$$

where t is the outflow time of the detergent, n is the number of the washing operation, x is the outflow time of the detergent in a first washing operation, and y is a constant;

and the control unit is configured to deliver the control signals corresponding to the determined outflow time.

33. The domestic dishwasher according to claim 1, further comprising a second openable closure on the cartridge, the second openable closure being for detergent delivery and is opened automatically on insertion of the cartridge into the detergent dosing system and is closed automatically on removal of the cartridge from the detergent dosing system; and a second delivery device for controlling detergent delivery from the second openable closure to the washing compartment, the second delivery device being fluidly connected to the second openable closure and the washing compartment, and being located fluidly between the second openable closure and the washing compartment, wherein the control unit is operatively connected to the second delivery device and configured to deliver control signals to the second delivery device to control an outflow time of a second detergent of the at least two detergents in a washing operation, the outflow time of the second detergent being dependant on a number of washing operations performed with the cartridge.

34. The detergent dosing system according to claim 31, further comprising a second openable closure on the cartridge, the second openable closure being for detergent delivery and is opened automatically on insertion of the cartridge into the detergent dosing system and is closed automatically on removal of the cartridge from the detergent dosing system; and a second delivery device for controlling detergent delivery from the second openable closure to the washing compartment, the second delivery device being fluidly connected to the second openable closure and the washing compartment, and being located fluidly between the second openable closure and the washing compartment, wherein the control unit is operatively connected to the second delivery device and configured to deliver control signals to the second delivery device to control an outflow time of a second detergent of the at least two detergents in a washing operation, the outflow time of the second detergent being dependant on a number of washing operations performed with the cartridge.

* * * * *

UNITED STATES PATENT AND TRADEMARK OFFICE

CERTIFICATE OF CORRECTION

PATENT NO. : 8,696,828 B2
APPLICATION NO. : 12/311098
DATED : April 15, 2014
INVENTOR(S) : Classen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1099 days.

Signed and Sealed this
Twenty-ninth Day of September, 2015

Michelle K. Lee

Michelle K. Lee
*Director of the United States Patent and Trademark Office*